US006328050B1

(12) United States Patent
McConnell

(10) Patent No.: US 6,328,050 B1
(45) Date of Patent: Dec. 11, 2001

(54) SELF-EXPECTING FOLDABLE PORTABLE STRUCTURE

(76) Inventor: Thomas E. McConnell, 1568 Calzada Ave., Santa Ynez, CA (US) 93460

( * ) Notice: Subject to any disclaimer, the term of this patent is extended or adjusted under 35 U.S.C. 154(b) by 0 days.

(21) Appl. No.: 09/517,408

(22) Filed: Mar. 2, 2000

(51) Int. Cl.[7] ..... E04H 15/44; E04H 15/52; E04H 15/56

(52) U.S. Cl. ..... 135/137; 135/126; 135/128; 135/143; 135/157; 135/116

(58) Field of Search ..... 135/123, 124, 135/125, 126, 128, 137, 143, 157, 116; 52/79.5, 222

(56) References Cited

U.S. PATENT DOCUMENTS

| | | |
|---|---|---|
| D. 274,662 | 7/1984 | Fausel . |
| D. 318,706 | 7/1991 | Norman . |
| D. 325,239 | 4/1992 | Norman . |
| D. 326,134 | 5/1992 | Norman . |
| 334,340 | 6/1886 | Barrow . |
| 1,135,892 | 4/1915 | Grosenbeck . |
| 1,155,475 | 10/1915 | Fay . |
| 1,206,618 | 11/1916 | Thrasher . |
| 1,360,844 | 11/1920 | Williams . |
| 1,538,260 | 5/1925 | Street et al. . |
| 1,581,888 | 4/1926 | Thomas . |
| 1,583,083 | 5/1926 | Macaraig . |
| 1,691,904 | 11/1928 | Gamble . |
| 1,797,978 | 3/1931 | Martin . |
| 1,994,235 | 3/1935 | Solomon . |
| 1,999,424 | 4/1935 | Seitz . |
| 2,269,574 | 1/1942 | Benefeld . |
| 2,298,786 | 10/1942 | Dubofsky et al. . |
| 2,575,893 | 11/1951 | Seaman . |
| 2,625,973 | 1/1953 | Weldon et al. . |
| 2,710,084 | 6/1955 | Braverman . |
| 2,749,582 | 6/1956 | Beck . |
| 2,778,560 | 1/1957 | Pfeiffer . |
| 3,233,644 | 2/1966 | Bono . |
| 3,675,667 | 7/1972 | Miller . |
| 3,727,786 | 4/1973 | Fausel . |
| 3,834,528 | 9/1974 | Pickford et al. . |
| 3,960,161 | 6/1976 | Norman . |
| 3,990,463 | 11/1976 | Norman . |
| 4,055,239 | 10/1977 | Weiner . |
| 4,165,757 | 8/1979 | Marks . |
| 4,265,261 | 5/1981 | Barker . |
| 4,299,365 | 11/1981 | Battle . |

(List continued on next page.)

FOREIGN PATENT DOCUMENTS

| | | |
|---|---|---|
| 2154734 | 1/1996 | (CA) . |
| 0924142A1 | 6/1999 | (EP) . |

*Primary Examiner*—Robert Canfield
(74) *Attorney, Agent, or Firm*—Stetina Brunda Garred & Brucker

(57) ABSTRACT

A self-expanding, foldable, portable structure for temporary shelter. The structure includes two opposing flexible side panels each having a continuous respective border thereabout and a continuous frame member fabricated of a foldable spring material for expanding and maintaining each side panel in a generally flat expanded configuration. Two opposing flexible end panels, a flexible roof panel, and preferably a floor panel are disposed between and connected to the side panels. A tension member is positionable between two opposing aligned sites of opposing frame members for maintaining under pressure the frame members in a spaced relationship from each other. A mat member having a frame fabricated of a foldable spring material can be provided for insertion to provide an inside floor surface between the opposing side panels while simultaneously tensionally distancing the side panels from each other to aid in stabilization of side panel positioning. The portable structure thus formed maximizes interior horizontal and vertical space while simultaneously providing collapsible transport coupled with self expandability for one person utility.

30 Claims, 3 Drawing Sheets

U.S. PATENT DOCUMENTS

| | | | | |
|---|---|---|---|---|
| 4,716,918 | | 1/1988 | Hayashida . | |
| 4,813,520 | | 3/1989 | Lin . | |
| 4,815,784 | | 3/1989 | Zheng . | |
| 4,825,892 | | 5/1989 | Norman . | |
| 4,858,634 | | 8/1989 | McLeese . | |
| 4,951,333 | | 8/1990 | Kaiser et al. . | |
| 4,953,815 | | 9/1990 | Beymer et al. . | |
| 4,995,487 | | 2/1991 | Plath . | |
| 5,009,189 | | 4/1991 | Neff . | |
| 5,024,262 | | 6/1991 | Huang . | |
| 5,038,812 | | 8/1991 | Norman . | |
| 5,072,828 | | 12/1991 | Irvine . | |
| 5,090,588 | | 2/1992 | Van Romer . | |
| 5,118,201 | | 6/1992 | Cook . | |
| 5,137,044 | | 8/1992 | Brady . | |
| 5,301,705 | | 4/1994 | Zheng . | |
| 5,337,772 | | 8/1994 | Habchi . | |
| 5,343,887 | * | 9/1994 | Danaher | 135/104 |
| 5,358,440 | | 10/1994 | Zheng . | |
| 5,360,028 | | 11/1994 | Jasin . | |
| 5,411,046 | * | 5/1995 | Wan | 135/126 |
| 5,439,017 | | 8/1995 | Brown . | |
| 5,467,794 | | 11/1995 | Zheng . | |
| 5,474,196 | | 12/1995 | Fausel et al. . | |
| 5,560,385 | | 10/1996 | Zheng . | |
| 5,576,621 | | 11/1996 | Clements . | |
| 5,579,799 | * | 12/1996 | Zheng | 135/126 |
| 5,592,961 | * | 1/1997 | Chin | 135/125 |
| 5,664,596 | | 9/1997 | Zheng . | |
| 5,664,886 | | 9/1997 | Hutchinson . | |
| 5,722,446 | | 3/1998 | Zheng . | |
| 5,778,915 | | 7/1998 | Zheng . | |
| 5,800,067 | | 9/1998 | Easter . | |
| 5,816,279 | | 10/1998 | Zheng . | |
| 5,941,265 | | 8/1999 | Zheng . | |
| 5,964,533 | | 10/1999 | Ziglar . | |
| 5,971,188 | | 10/1999 | Kellogg et al. . | |
| 5,975,101 | | 11/1999 | Zheng . | |
| 6,006,772 | | 12/1999 | Zheng . | |
| 6,098,349 | * | 8/2000 | Zheng | 135/126 |
| 6,109,281 | * | 8/2000 | Lowenthal | 135/143 X |
| 6,155,281 | * | 12/2000 | Zheng | 135/126 |

* cited by examiner

SELF-EXPECTING FOLDABLE PORTABLE STRUCTURE

CROSS-REFERENCE TO RELATED APPLICATIONS (Not Applicable)

STATEMENT RE: FEDERALLY SPONSORED RESEARCH/DEVELOPMENT (Not Applicable)

FIELD OF THE INVENTION

The present invention relates in general to portable structures, and in particular to a self-expanding foldable portable structure such as a tent or cabana having side-member frame members fabricated of a spring material foldable to store kinetic energy and kinetically self-expandable for maintaining each opposing side panel in an expanded configuration in cooperation with connected roof and end panels to sustain the structure in place.

BACKGROUND OF THE INVENTION

The use of portable structures such as tents, cabanas, and the like, is a popular and effective way for providing shelter for both children and adults. In particular, such structures can be used to provide protection over a broad scope of conditions ranging from insulated winter camping quarters in desolate terrain to light weight sun ray protection at a beach. Irrespective of the weight or the use of such a structure, however, is the fact that the structure must be transported to, and erected at, the designated site of use. Transportation factors include size considerations, while assembly factors include ease of completion in conjunction with number of people and types of special tools needed to accomplish construction.

Portable structures such as tents generally include side, end, roof, and, usually, floor panels that cooperate with each other when the tent structure is finally erected to provide an enclosure whose size can accommodate one or more persons. Traditional construction generally requires the assembly of frame members, engagement of these frame members with appropriate structural panels, and the use of ground-hammered stakes securing ropes extending from the tent structure to thereby maintain the structure in an upright position. While portable structures so built can provide needed shelter, the actual assembly and disassembly can be cumbersome and even, depending on structure size, impossible for one person to handle.

Certain assembly difficulties have been recognized in the prior art, and attempts to lessen such hardships have been through use of an A-shaped frame wherein a self-expanding spring steel or similar material is provided as two opposing frame members joined at their respective tops in figure-eight fashion to flay outwardly with fabric attached thereto and thereby provide opposing side panels as an A-shaped structure. As is apparent, however, such a top-joining frame construction severely limits interior width dimensions since the top of the portable structure must always be an apex. Further, and beyond limitations on width dimensions, this required A-shape eliminates all perpendicular side panel configurations, thus eliminating vertical uniformity within the structure.

In view of the above disadvantages inherent in prior art portable structures, it is apparent that a need is present for a portable structure that is easily erected through self-expandability, that is collapsible to a reasonable carrying, size, and that can provide generally perpendicularly vertical side panels to thereby maximize interior structure volume. Accordingly, a primary object of the present invention is to provide a foldable portable structure having opposing self-expanding side walls each with a separate frame member and separated from each other by end and roof panels.

Another object of the present invention is to provide a foldable portable structure wherein the respective frame members are fabricated of a spring material that is self-expandable when not physically confined for expanding and maintaining each side panel in a generally flat expanded configuration.

Yet another object of the present invention is to provide a foldable portable structure wherein at least one tension member is positionable by friction fit between opposing aligned sites of the frame members for pressuredly maintaining the frame members in a spaced relationship from each other.

These and other objects of the present invention will become apparent throughout the description thereof which now follows.

BRIEF SUMMARY OF THE INVENTION

The present invention is a self-expanding, foldable, portable structure, such as a tent, cabana, or similar structure, for temporary placement on the ground or other generally flat surface to thereby provide shelter for an occupant. The structure comprises two opposing flexible side panels each having a continuous respective border thereabout. A continuous frame member is disposed at each respective border of each side panel and is fabricated of a spring material foldable to store kinetic energy and kinetically self-expandable when not physically confined for expanding and maintaining each side panel in a generally flat expanded configuration. Two opposing flexible end panels are disposed between and connected to the side panels, while a flexible roof panel likewise is disposed between and connected to the side panels. Preferably, a flexible floor panel is likewise disposed between and connected to the side panels. The structure can include a tension member for placement between two opposing aligned sites of opposing frame members for maintaining under pressure the frame members in a spaced relationship from each other. Position maintenance of the structure at a ground site can be enhanced by providing at least one externally accessible pocket disposed along a bottom portion of each side panel for receiving therein a weight, or by including stake accepting members for stake securement of the structure on an impregnable surface. Entry into the structure can be accommodated by providing an opening through at least one of the end panels through which a person can pass. Finally, a mat member having a frame fabricated of a spring material foldable to store kinetic energy and kinetically self-expandable when not physically confined can be provided for insertion within the portable structure to provide an inside floor surface between the opposing side panels while simultaneously tensionally distancing the side panels from each other to aid in stabilization of side panel positioning. Because the flexible end panels, roof panel, and preferable floor panel are disposed between and connected to the side panels, the portable structure thus formed provides an exceptional width dimension not limited by opposing frame connections as in the prior art. The present structure provides easy and stable construction for formation of a shelter that maximizes interior horizontal and vertical space while simultaneously providing ready transport and one person assembly.

BRIEF DESCRIPTION OF THE SEVERAL VIEWS OF THE DRAWING

An illustrative and presently preferred embodiment of the invention is shown in the accompanying drawings in which.

DETAILED DESCRIPTION OF THE INVENTION

Figure 1:
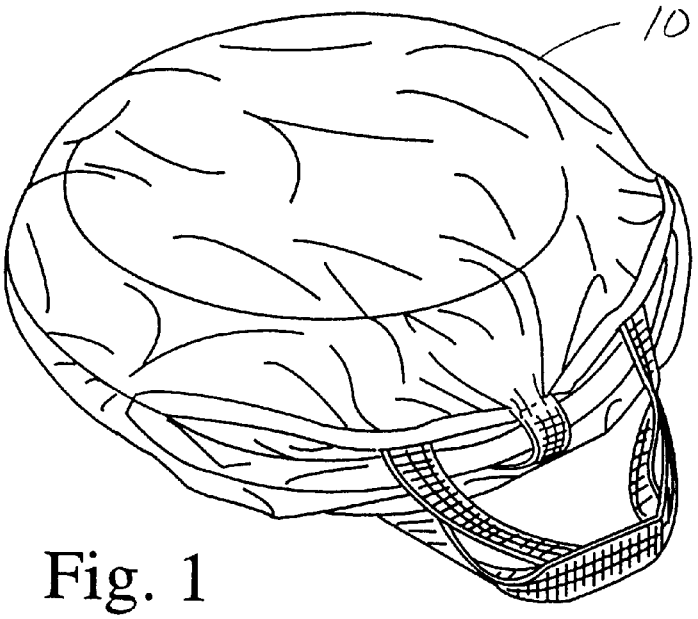
FIG. 1 is a perspective view of a carrier bag housing a self-expanding foldable portable structure.
Figure 2:
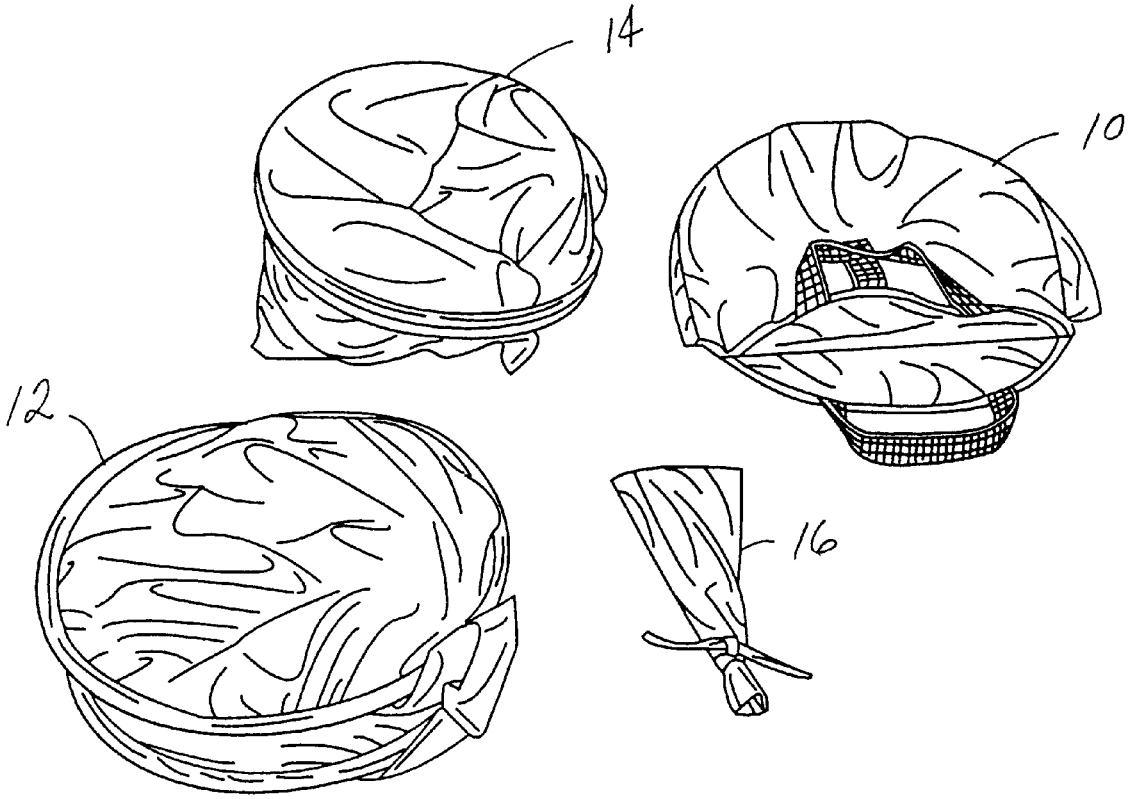
FIG. 2 is a perspective view of components within the carrier bag of FIG. 1.
Figure 3:
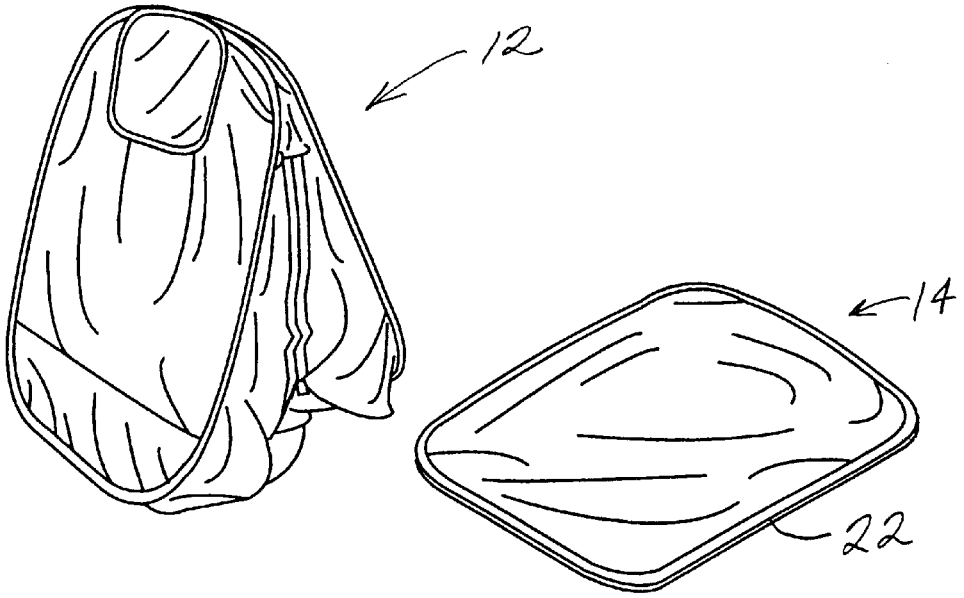
FIG. 3 is a perspective view of a first embodiment of a partially expanded self-expanding foldable portable structure with a non-inserted mat member.
Figure 4:
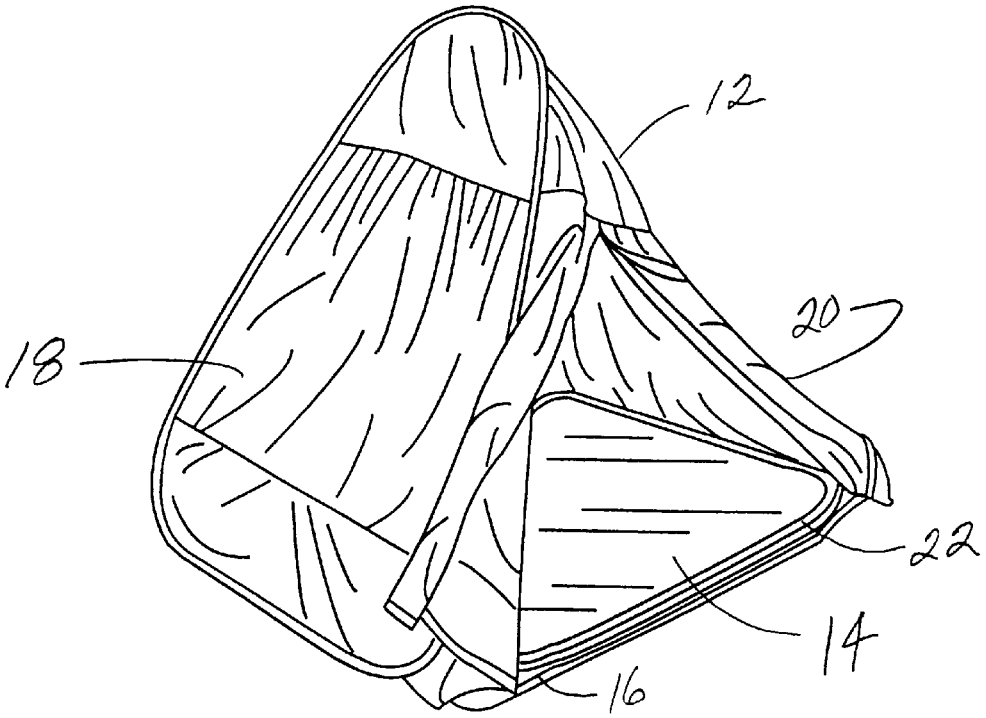
FIG. 4 is a perspective view of the portable structure of FIG. 3 more fully expanded and with the mat member inserted therein.

Referring first to FIGS. 1 and 2, a carrier bag 10 housing a collapsed self-expanding foldable portable structure 12, a collapsed self-expanding mat member 14, and a pouch 16 for housing stakes is shown. As is apparent, the portable structure 12 and mat member 14 are sufficiently foldable to fit within the carrier bag 10. FIGS. 3 and 4 illustrate a progression of self-expansion of the structure 12 and mat member 14. Specifically, in FIG. 3, the structure 12 is spread apart at its base while the mat member 14 is fully expanded. In FIG. 4, the mat member 14 is inserted within the structure 12 to thereby fully spread the base of the structure 12. As is evident in FIG. 4, the structure 12 has a floor panel 16 with the mat member 14 inserted immediately above and parallel with the floor panel 16 and between the opposing side panels 18, 20 of the structure 12. The mat member 14 is constructed of a water repellant fabric material, and has a continuous frame member 22 about its entire perimeter fabricated of a spring material non-limitedly exemplified as flexible coilable steel or flat spring steel stock foldable to store kinetic energy and kinetically self-expandable when not physically confined for expanding and maintaining the mat member in a generally flat expanded configuration as shown. Size of the mat member 14 is sufficient to substantially fully cover the floor panel 16 and for tensionally distancing the side panels 18, 20 from each other as described below.

Figure 6:
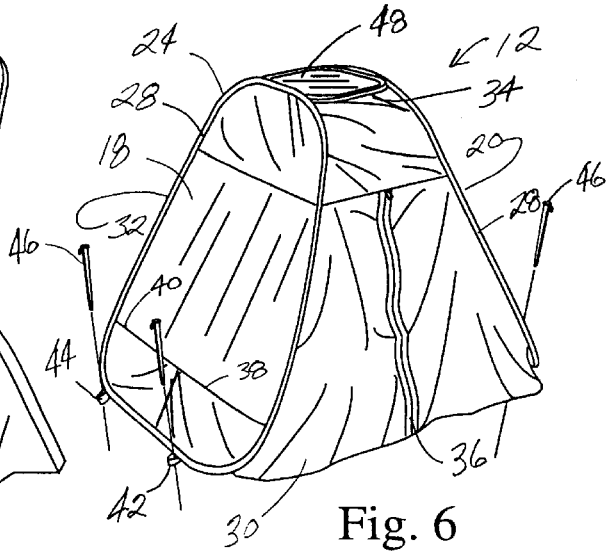
FIG. 6 is a perspective view of the portable structure of FIG. 3 fully expanded and showing the tension member in place and with stake anchoring for the structure.

FIG. 6 best illustrates the portable structure 12 in fully expanded and usable configuration. Specifically, the structure 12 includes two opposing identical side panels 18, 20 each constructed of a water repellant fabric material as known in the art. Because the side panels 18, 20 are identical, the description herein will refer only to the side panel 18, with the understanding that the side panel 20 is a twin. The side panel 18 has a continuous border 24 thereabout with a sleeve within which is a continuous sleeved frame member 28 to thereby accompany the entire border 24. The frame member 28 is fabricated of a spring material foldable to store kinetic energy and kinetically self-expandable when not physically confined for expanding and maintaining the side panel 18 in a generally flat expanded configuration as shown in FIG. 6. While flexible coilable steel or flat spring steel stock are preferred spring materials for the frame member 28, it is to be understood that other materials, including plastics, that exhibit the utilitarian characteristics here described can be employed.

The structure 12 has two opposing end panels 30, 32, a roof panel 34, and a floor panel 16 (FIG. 4), all constructed of a water repellant fabric material and respectively disposed between and connected by sewn thread stitching to the side panels 18, 20. At least one end panel 30 includes an opening 36 therethrough, which can be zipper-closable as shown, for access to the interior of the structure 12. In the embodiment here shown, the opposite end member 32 is identical to the visible end member 30 except for having an opening therethrough into the structure 12. Maintenance of the structure 12 at a chosen site can be accomplished in one or two ways. In particular, each side panel 18, 20 is provided with two adjacent pockets 38, 40 within which a weight, such as a quantity of sand as is found at a beach location, can be placed to thereby stabilize the side panels 18, 20 in relation to surface placement. Additionally, each side panel 18, 20 is provided with two loop members 42, 44 that function to accept respective stakes 46 that can be driven into an impregnable surface such as natural ground to once again stabilize the side panels 18, 20 in relation to surface placement.

Figure 5:
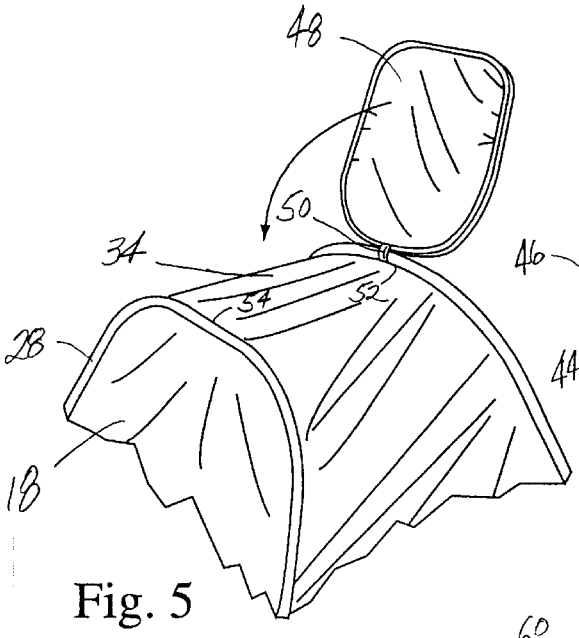
FIG. 5 is a perspective view of a top portion of the portable structure of FIG. 4 showing a tension member hingedly attached.

Tensioning of the continuous frame members 28 of the respective side panels 18, 20 in a constructed configuration is accomplished by a tension member here non-limitedly exemplified and illustrated in FIGS. 5 and 6 as an exteriorly-accessible, rigidly-bordered panel 48 retained by a pivot or hinge member 50 adjacent the roof panel 34. The panel 48 is pivotally movable as illustrated by the arrow of FIG. 5 for friction-fit placement between two aligned opposing sites 52, 54 of the opposing frame members 28 as shown in FIG. 6 to thereby maintain outward tensionally distancing pressure on the opposing frame members 28. In a like manner, as earlier alluded to in connection with FIG. 4, when the mat member 14 is inserted between the opposing side panels 18, 20 immediately above and parallel with the floor panel 16, its frame member 22 abuts opposing aligned bottom sites of the opposing frame members 28 of the side panels 18, 20 to thus maintain outward tensionally distancing pressure on the bottom of the opposing frame members 28 for equivalent structural stabilization. Should a floor panel 16 not be present, the mat member 14 can be positioned immediately above a surface upon which the portable structure 12 is situated to accomplish identical outward tensionally distancing pressure.

Figure 7:
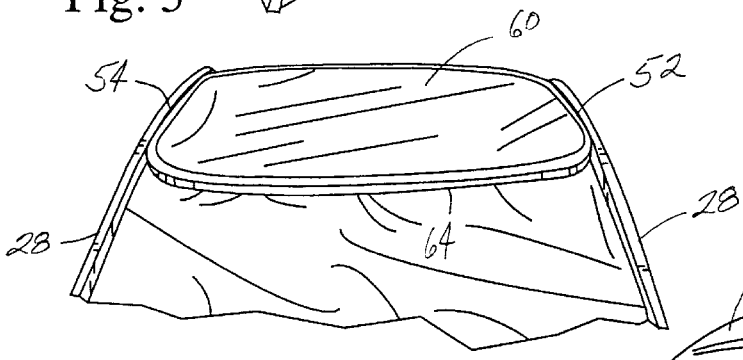
FIG. 7 is a perspective view of a roof portion of a second embodiment of a self-expanding foldable portable structure.
Figure 8:
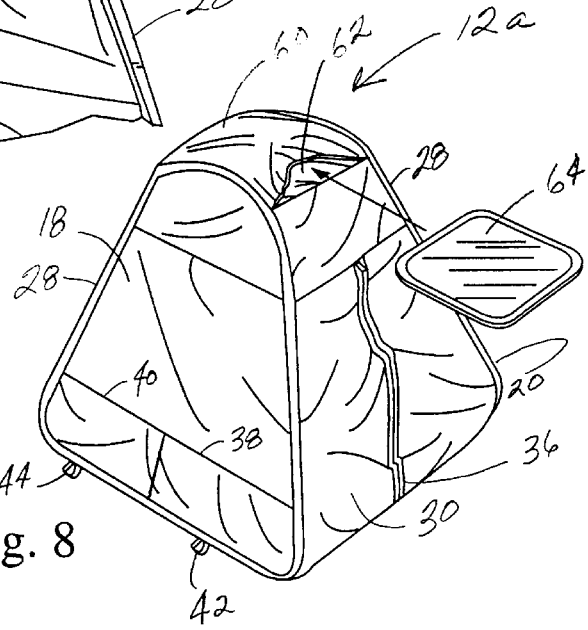
FIG. 8 is a perspective view of the entire second embodiment of the self-expanding foldable portable structure of FIG. 7.

FIGS. 7 and 8 illustrate a second embodiment of a self-expanding foldable portable structure 12*a* wherein all components thereof are identical to the first embodiment as shown in FIGS. 1–6 except for construction of the roof panel 34 and absence of pivotal retention of the rigidly-bordered panel 48 adjacent the roof panel 34. Specifically, the roof panel 60 of the structure 12*a* of FIGS. 7 and 8 includes a pocket 62 across the entire distance between frame members 28, while the tension member is a rigidly-bordered panel 64 tightly insertable into the pocket 62. Such insertion of the panel 64 within the pocket 62 results in friction-fit placement of the panel 64 between two aligned opposing sites 52, 54 of the opposing frame members 28 to thereby maintain outward tensionally distancing pressure on these opposing frame members 28. In all other respects, the embodiment of FIGS. 7 and 8 is identical to the embodiment of FIGS. 1–6.

As is apparent, the self-expanding foldable portable structure here defined and described provides a stable shelter with maximized interior dimensions while simultaneously permitting compact transport coupled with one-person assembly. While illustrative and presently preferred embodiments of the invention have been described in detail herein, it is to be understood that the inventive concepts may be otherwise variously embodied and employed and that the appended claims are intended to be construed to include such variations except insofar as limited by the prior art.

What is claimed is:

1. A self-expanding foldable portable structure comprising:

a) two opposing flexible side panels each having a continuous respective border thereabout;

b) a continuous frame member disposed at each respective border of each side panel, said frame member fabricated of a spring material foldable to store kinetic energy and kinetically self-expandable when not physically confined for expanding and maintaining each side panel in a generally flat expanded configuration;

c) two opposing flexible end panels each disposed between and connected to the side panels;

d) a flexible roof panel disposed between and connected to the side panels;

e) a flexible floor panel disposed between and connected to the side panels; and f) a mat member insertable within the portable structure immediately above and parallel with the floor panel and between the opposing side panels and of a size for tensionally distancing said side panels from each other, the mat member being defined by a perimeter whose entirety includes a continuous frame member fabricated of a spring material foldable to store kinetic energy and kinetically self-expandable when not physically confined for expanding and maintaining the mat member in a generally flat expanded configuration.

2. A self-expanding foldable portable structure as claimed in claim 1 wherein the side panels, end panels, roof panel, and floor panel are constructed of a water repellant fabric material.

3. A self-expanding foldable portable structure as claimed in claim 1 additionally comprising a tension member for placement between two opposing aligned sites of opposing frame members for maintaining under pressure said frame members from each other.

4. A self-expanding foldable portable structure as claimed in claim 3 wherein the tension member is a rigidly-bordered panel for friction fit placement between two opposing aligned sites of said opposing frame members.

5. A self-expanding foldable portable structure as claimed in claim 4 wherein said opposing aligned sites are situated adjacent the roof panel.

6. A self-expanding foldable portable structure as claimed in claim 5 wherein the rigidly-bordered panel is externally accessible and pivotally retainably attached adjacent the roof panel for selective friction-fit placement between said opposing aligned sites.

7. A self-expanding foldable portable structure as claimed in claim 5 additionally comprising an externally accessible pocket situated between said opposing aligned sites within the roof panel for receiving a rigidly-bordered panel therein for friction-fit placement between said opposing aligned sites.

8. A self-expanding foldable portable structure as claimed in claim 1 wherein at least one end panel has therethrough an entry into the portable structure.

9. A self-expanding foldable portable structure as claimed in claim 1 additionally comprising at least one externally accessible pocket disposed along a bottom portion of each side panel for receiving therein a weight for maintaining the portable structure in place on a surface.

10. A self-expanding foldable portable structure as claimed in claim 1 additionally comprising a plurality of stake accepting members for stake securement of the portable structure on an impregnable surface.

11. A self-expanding foldable portable structure as claimed in claim 1 wherein the mat member is substantially identical in size to the floor panel.

12. A self-expanding foldable portable structure comprising:

a) two opposing flexible side panels each having a continuous respective border thereabout;

b) a continuous frame member disposed at each respective border of each side panel, said frame member fabricated of a spring material foldable to store kinetic energy and kinetically self-expandable when not physically confined for expanding and maintaining each side panel in a generally flat expanded configuration;

c) two opposing flexible end panels each disposed between and connected to the side panels;

d) a flexible roof panel disposed between and connected to the side panels; and e) a rigidly-bordered panel for friction fit placement between two opposing aligned sites of opposing frame members for maintaining under pressure said frame members from each other.

13. A self-expanding foldable portable structure as claimed in claim 12 wherein the side panels, end panels, and roof panel are constructed of a water repellant fabric material.

14. A self-expanding foldable portable structure as claimed in claim 12 wherein said opposing aligned sites are situated adjacent the roof panel.

15. A self-expanding foldable portable structure as claimed in claim 14 wherein the rigidly-bordered panel is externally accessible and pivotally retainably attached adjacent the roof panel for selective friction-fit placement between said opposing aligned sites.

16. A self-expanding foldable portable structure as claimed in claim 14 additionally comprising an externally accessible pocket situated between said opposing aligned sites within the roof panel for receiving a rigidly-bordered panel therein for friction-fit placement between said opposing aligned sites.

17. A self-expanding foldable portable structure as claimed in claim 12 wherein at least one end panel has therethrough an entry into the portable structure.

18. A self-expanding foldable portable structure as claimed in claim 12 additionally comprising at least one externally accessible pocket disposed along a bottom portion of each side panel for receiving therein a weight for maintaining the portable structure in place on a surface.

19. A self-expanding foldable portable structure as claimed in claim 12 additionally comprising a plurality of stake accepting members for stake securement of the portable structure on an impregnable surface.

20. A self-expanding foldable portable structure as claimed in claim 12 additionally comprising a mat member whose entire perimeter includes a continuous frame member fabricated of a spring material foldable to store kinetic energy and kinetically self-expandable when not physically confined for expanding and maintaining the mat member in a generally flat expanded configuration, said mat member insertable within the portable structure immediately above and parallel with a surface upon which the portable structure is situated and between the opposing side panels, said mat of a size for tensionally distancing said side panels from each other.

21. A self-expanding foldable portable structure comprising:

a) two opposing flexible side panels each having a continuous respective border thereabout;

b) a continuous frame member disposed at each respective border of each side panel, said frame member fabricated of a spring material foldable to store kinetic energy and kinetically self-expandable when not physically confined for expanding and maintaining each side panel in a generally flat expanded configuration;

c) two opposing flexible end panels each disposed between and connected to the side panels;

d) a flexible roof panel disposed between and connected to the side panels;

e) a flexible floor panel disposed between and connected to the side panels; and f) a removably insertable mat member disposed above and parallel with the floor panel, the mat member further being disposed between the opposing side panels for tensionally distancing said side panels from each other, the mat member having a perimeter defined by a continuous frame member sized and configured to be foldable to store kinetic energy and kinetically self-expandable when not physically confined for expanding and maintaining the mat member in a generally flat expanded configuration.

22. A self-expanding foldable portable structure as claimed in claim 21 wherein the continuous frame member is fabricated from a spring material.

23. A self-expanding foldable portable structure adapted to be installed upon a horizontal surface, the structure comprising:

a) two opposing flexible side panels each having a continuous respective border thereabout, said side panels being installable upon said horizontal surface;

b) a continuous frame member disposed at each respective border of each side panel, said frame member being foldable to store kinetic energy, said frame member further being kinetically self-expandable to maintain each side panel in a generally flat expanded configuration when the frame member is not physically confined;

c) two opposing flexible end panels each disposed between and connected to said side panels;

d) a flexible roof panel disposed between and connected to said side panels; and e) a removably insertable mat member, the mat member being insertable between said opposing side panels parallelly above said horizontal surface when said side panels are installed upon said horizontal surface, said mat member further being removable therefrom when said side panels are uninstalled from said horizontal surface.

24. A self-expanding foldable portable structure as claimed in claim 23 wherein the side panels, end panels, roof panel, and floor panel are constructed of a water repellant fabric material.

25. A self-expanding foldable portable structure as claimed in claim 23 wherein said frame member is fabricated of a spring material.

26. A self-expanding foldable portable structure as claimed in claim 23 wherein at least one end panel has therethrough an entry into the portable structure.

27. A self-expanding foldable portable structure as claimed in claim 23 additionally comprising at least one externally accessible pocket disposed along a bottom portion of each side panel for receiving therein a weight for maintaining the portable structure in place upon said horizontal surface.

28. A self-expanding foldable portable structure as claimed in claim 23 additionally comprising a plurality of stake accepting members for stake securement of the portable structure upon said horizontal surface.

29. A self-expanding foldable portable structure as claimed in claim 23 wherein said mat member comprises a perimeter defined by a continuous frame member sized and configured to be foldable to store kinetic energy and kinetically self-expandable when not physically confined for expanding and maintaining the mat member in a generally flat expanded configuration.

30. A self-expanding foldable portable structure as claimed in claim 23 wherein said mat member is sized and configured to tensionally distance said side panels from each other when inserted therebetween.

* * * * *

UNITED STATES PATENT AND TRADEMARK OFFICE

CERTIFICATE OF CORRECTION

PATENT NO. : 6,328,050 B1
DATED : December 11, 2001
INVENTOR(S) : Thomas E. McConnell It is certified that error appears in the above-identified patent and that said Letters Patent is hereby corrected as shown below:

Title page,
Item [54], should read as follows:
-- [54] SELF-EXPANDING FOLDABLE PORTABLE STRUCTURE --

Signed and Sealed this

Fourth Day of June, 2002

*Attest:*

*Attesting Officer*

JAMES E. ROGAN
*Director of the United States Patent and Trademark Office*